US010179691B2

(12) United States Patent
McCarren

(10) Patent No.: US 10,179,691 B2
(45) Date of Patent: Jan. 15, 2019

(54) CABLE RETAINERS FOR PACKAGING

(71) Applicant: Apple Inc., Cupertino, CA (US)

(72) Inventor: Jonathan M. McCarren, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/467,917

(22) Filed: Mar. 23, 2017

(65) Prior Publication Data

US 2018/0273282 A1 Sep. 27, 2018

(51) Int. Cl.

*B65D 85/04* (2006.01)
*B65H 55/00* (2006.01)
*B65H 75/36* (2006.01)

(52) U.S. Cl.

CPC ..... *B65D 85/04* (2013.01); *B65H 55/00* (2013.01); *B65H 75/364* (2013.01); *B65H 2701/3919* (2013.01)

(58) Field of Classification Search

CPC ..... B65B 5/04; B65B 63/04; B65D 85/02; B65D 85/04; B65D 85/671; B65D 85/672; B65H 3/00; B65H 55/00; B65H 75/06; B65H 75/26; B65H 75/364; B65H 2701/3919

USPC ..... 206/303, 388, 394–398

See application file for complete search history.

(56) References Cited

U.S. PATENT DOCUMENTS 1,871,388 A * 8/1932 Pflueger ..... B65D 85/04 206/395
1,927,667 A * 9/1933 Miller ..... B65D 85/671 242/596.6
2,458,898 A 1/1949 Di Addario
2,674,372 A * 4/1954 Schweich ..... B65D 85/04 206/303
2,778,760 A * 1/1957 Hurst ..... B32B 27/00 229/5.82
2,812,854 A 11/1957 Fletcher
2,971,231 A * 2/1961 Stoddart ..... B65D 63/14 206/397
3,107,880 A * 10/1963 Lawlis ..... B65H 75/20 206/397
3,223,233 A 12/1965 Becker et al.
(Continued)

OTHER PUBLICATIONS

DetroitBORG, "Apple iMac 27" 5K Retina Display: Unboxing—Awesome Stuff Week, posted at youtube.com, <https://www.youtube.com/watch?v=PlwV4WggokM>.

*Primary Examiner* — Byron Gehman
(74) *Attorney, Agent, or Firm* — Sterne, Kessler, Goldstein & Fox P.L.L.C.

(57) ABSTRACT

Cable retainers may include a panel having a pair of loop locks. The loop locks may engage each other to form a loop. The cable retainer may include a first and a second retention loop. Each retention loop may have a finger with a slot formed at a fold line of the finger. Each retention loop may also have a flap with a tab formed at a fold line of the flap. The finger and the flap of the first retention loop may be located directly across the panel from one another. The finger of the second retention loop may be located at a first end of the panel while the flap of the second retention loop may be located at a second end of the panel. The tabs and slots of each retention loop may interlock to form a rectangular cable passage. The cable retainer may be formed entirely of paper and may be formed without adhesive.

20 Claims, 7 Drawing Sheets

(56) References Cited

U.S. PATENT DOCUMENTS

| | | | | |
|---|---|---|---|---|
| 3,246,742 | A | 4/1966 | Coe | |
| 3,329,259 | A | 7/1967 | Mayer | |
| 3,439,863 | A | 4/1969 | Hayes | |
| 3,446,419 | A | 5/1969 | Mueller | |
| 3,520,988 | A | 7/1970 | Ballock | |
| 3,796,304 | A | 3/1974 | Blais | |
| 3,947,313 | A * | 3/1976 | Lichtwardt | B65C 11/00 206/396 |
| 4,019,636 | A | 4/1977 | Wise | |
| 4,179,030 | A * | 12/1979 | Hayes | B65D 85/672 206/396 |
| 4,239,110 | A | 12/1980 | Enke et al. | |
| 4,824,041 | A | 4/1989 | Myers | |
| 5,020,660 | A | 6/1991 | Akerley et al. | |
| 5,129,514 | A | 7/1992 | Lilley, Jr. | |
| 5,172,879 | A | 12/1992 | Calmettes et al. | |
| 5,494,168 | A | 2/1996 | Hart | |
| 6,467,623 | B1 | 10/2002 | Lewis et al. | |
| 7,306,101 | B2 | 12/2007 | Murry | |
| 8,430,243 | B2 * | 4/2013 | Quehl | B65H 75/4471 206/388 |
| 8,844,726 | B2 | 9/2014 | Andre et al. | |
| 9,073,727 | B2 * | 7/2015 | Solomon | B65B 63/06 |
| 2006/0130290 | A1 | 6/2006 | Yi | |
| 2007/0051662 | A1 | 3/2007 | Millar-Sax et al. | |
| 2007/0138050 | A1 | 6/2007 | Dominey | |
| 2015/0375893 | A1 | 12/2015 | Korinek | |
| 2016/0009473 | A1 | 1/2016 | Korinek et al. | |
| 2017/0088392 | A1 * | 3/2017 | Wang | B65H 75/06 |

* cited by examiner

CABLE RETAINERS FOR PACKAGING

FIELD

The described embodiments relate generally to cable retainers. More particularly, the described embodiments relate to cable retainers formed entirely of paper.

SUMMARY

In some embodiments described herein, a cable retainer includes a panel with of pair of loop locks configured to engage each other to form a loop. A first and a second retention loop may have attached to the panel. Each retention loop includes a finger having a slot formed at a fold line of the finger and a flap having a tab formed at the fold line of the flap. The finger and flap of the first retention loop may be located directly across the panel from one another while the finger and flap of the second retention loop may be located at a first end and a second end of the panel, respectively. The tab the flap mates with the slot of the finger to form a cable passage. The cable passage may be rectangular. The tab may be removed from and reinserted into the slot. The cable retainer may be formed entirely of paper, with no adhesive.

The cable retainer may be a single integrally formed piece and may be formed from a flat blank. The cable retainer may also be coated (e.g., with a laminate). Folds in the cable retainer may be preformed in the single integrally formed piece. The cable retainer may be formed entirely of a recyclable material (e.g., a paper-based material such as cardboard, paperboard, or cardstock) and may have the same number of fingers extending from the top side as the bottom side of the panel. The cable retainer may have all the fingers extending from one side of the panel.

The cable retainer may include a foldable port securement member configured to mate with a retained cable. The port securement member may be foldable. The port securement member in the folded configuration may engage the port of a wound cable secured by the cable retainer.

A packaged cable disclosed herein may include a cable retainer and a wound cable extending through the retention loop of the cable retainer. The cable may be wound such that each loop of the cable is in contact with immediately adjacent loops along a majority of each loop.

In some embodiments fingers and tabs for a cable retainer may include finger segments and flap segments, respectively. A finger and flap may together form a retention loop, and may be coupled together by a tab formed at a fold line between the two flap segments and a slot formed at a fold line between two of the finger segments. A rectangular cable passage may be formed when the tab engages the slot. Each finger segment may be folded at a right angle relative to an adjacent finger segment. Similarly, each flap segment may be folded at a right angle relative to an adjacent flap segment. A panel may extend between retention loops to form a form a cable retainer. A finger and a flap segment adjacent the panel may be folded at a right angle relative to the panel.

The cable retainer formed of retention loops may include a wound cable that extends through the retention loops of the cable retainer. The loops of the wound cable may be disposed on the same plane. A removal tab may extend from the cable retainer to aid the user in removing a packaged cable from product packaging. The removal tab may be, for example, semi-circular.

The cable retainer may include a panel having at least three folds. One of the folds may not entirely across the panel. The fold may connect to a cut-out of the panel. A second of the folds may be formed in the cut-out and may be interrupted by a tab such that the second of the folds does not extend entirely across the cut-out. The cut-out may have a semi-circular end. A tab formed in the cut-out may have a semi-circular end and semi-circular ends of the tab and the cut-out may point in opposite directions. According to some embodiments disclosed herein, the cable retainer is formed entirely of paper, with no adhesive.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
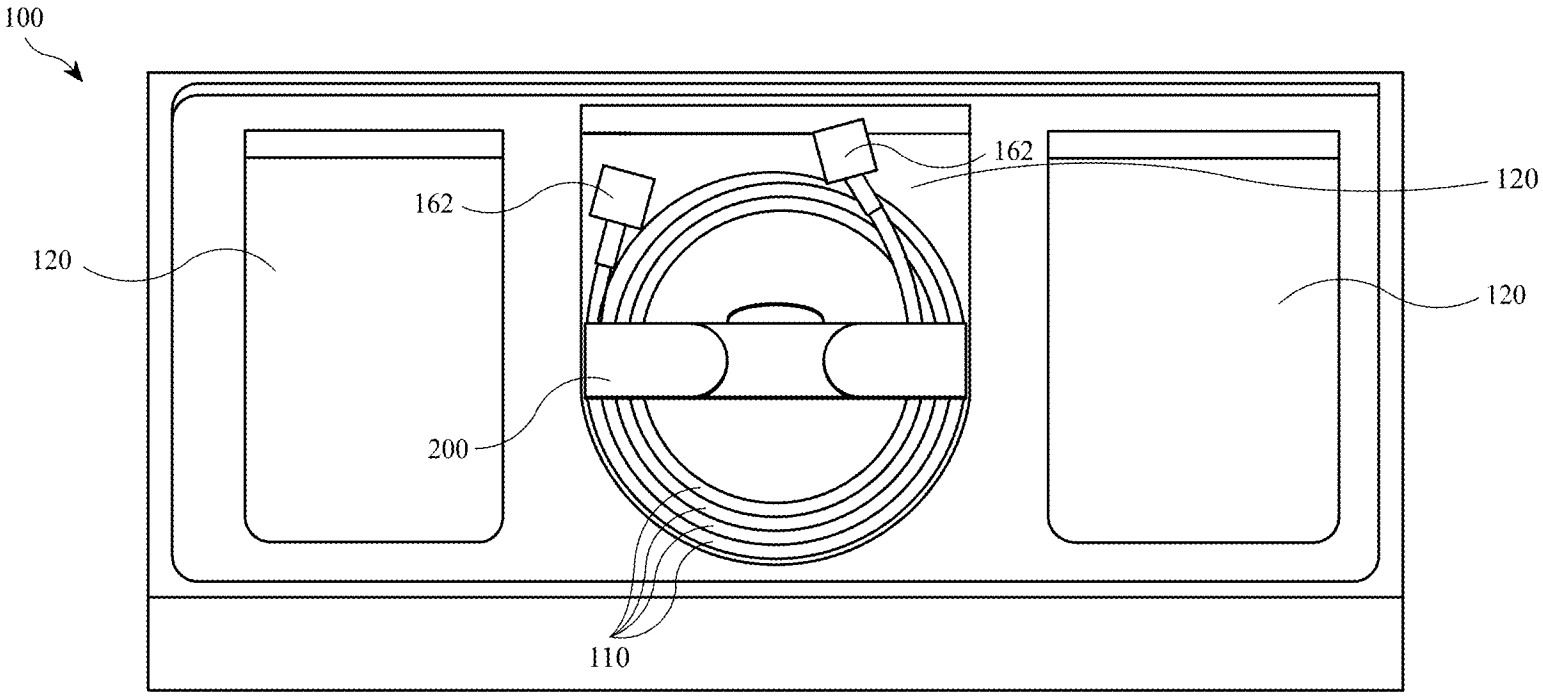
FIG. 1 shows packaging with a cable retainer.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the claims.

Many products utilize cables in some form or another. For example, an electronic device may utilize one or more cables to receive or transmit power and/or data (e.g., audio or video signals). In some instances, it may be desirable to store and/or package the cable(s) (e.g., between uses, in transit, or while presented for sale).

Cable retainers protect cables and products from damage and facilitate brand recognition. Cable retainers also contribute to effective and attractive packaging and may be an important tool used to attract and retain customers. In some embodiments, cable retainers are easily undone for removal of a cable. This can reduce customer frustration.

While ease of operating cable retainers to access a retained cable may be desirable from a customer standpoint, efficiency and cost in manufacturing and constructing (assembling) cable retainers may be a consideration for manufactures and/or sellers of the packaging. For example, environmental considerations may play a role in developing cable retainers. Cable retainers made out of recyclable and/or biodegradable material can reduce environmental impact. Additionally, cable retainers that utilize minimal resources, from a material, energy, and/or labor perspective, may be desirable. For example, it may be desirable to make a cable retainer from a single raw product, such as, for example, paper. Further, cable retainers that require a relatively small number of manufacturing and/or assembly steps may reduce costs (e.g., manpower and machine costs) associated with the packaging. Maintaining desired aesthetics and function of cable retainers in view of such environmental and resource considerations can be a challenge.

The retainers discussed herein may be used to hold, display, and/or transport cables (e.g., power and/or data cables), whether separately or as connected to a product. The cable retainers discussed herein may hold and display wound cable in an aesthetically appealing and customer-friendly fashion. The cable retainers may maintain a wound cable in a compact configuration. A cable retainer may be disposed in a cavity of a packaging container, which may present a wound cable in a fashion that facilitates easy and intuitive removal of the cable retainer and/or wound cable from the packaging by a customer, such as, for example, by releasing a tab of the cable retainer from a slot of the cable retainer.

A cable retainer may be folded about the wound cable and secured to itself with the use of a tab and slot coupling. The cable retainer may present to a customer one or more free ends releasably attached to other portions the cable retainer. Pulling the free ends may release an attachment, for example a tab from a slot, between the cable retainer and the packaging and/or between different portions of the cable retainer. Pulling on the free ends may cause the cable retainer to unfold, thereby allowing a wound cable to be removed from a packaging container and/or the cable retainer. In some embodiments, the cable retainer may be re-constructed (e.g., re-folded) by re-attaching the free ends to respective portions of the cable retainer.

Cable retainers discussed herein and features thereof may be used to package merchandise other than wound cables. In such cases, the retainer may function as a "product retainer" or "accessory retainer." For example, cable retainers discussed herein may be used to package products having a cable (or cord) physically attached to them, such as a wired headset, wired earphones, mouse, keyboard, or other device. Also, packaging and cable retainers may be used to package non-wired products. For example, the cable retainers may be used to package products by being partially folded about the product. Such products/accessories may include but are not limited to, wireless headphones, wireless headsets, remote controls, or printed materials.

A cable retainer may be used to retain a cable (which may also be referred to as a cord). Typically, a cable has a length many times greater than its width. For packaging, a cable may be coiled upon itself (i.e., wound) to create a compact configuration to occupy a compact area, in order to efficiently store/package the cable. The cable may be wound any suitable number of times. Adjacent cable windings may be flush with one another. In some embodiments, the wound cable contained in the cable retainer may be described as a hanked cable. A hanked cable may have a visually appealing symmetry. In some embodiments, separate coils of the hanked cable have outer tangent lines that lie in the same plane. An exemplary, hanked cables is shown and described in U.S. Pat. No. 9,073,727, issued Jul. 7, 2015, titled "Systems and Methods for Hanking a Cable," which is incorporated herein in its entirety by reference thereto.

A cable retainer may be composed of a recyclable material (e.g., a biodegradable or compostable material). For example, the cable retainer may be composed of a paper-based product such as, for example, cardboard or paperboard (e.g., solid bleached sulfate (SBS)). The cable retainer may also be composed of a polymeric material such as, for example, polyethylene, polypropylene, polyurethane, polystyrene, polymer blends including one or more of these polymers, or co-polymers including one or more of these polymers). In some embodiments, all or some of the exterior surfaces of the cable retainer may be laminated.

Additionally, the packaging and/or cable retainers may be manufactured in a cost-effective and environmentally friendly way. For example, a cable retainer may be constructed of a single integrally formed piece of material. This piece of material may be folded into a configuration that holds and secures a wound cable, either alone or within a cavity of a packaging container. The foldable material may be a single piece of material that is cut by a single operation (e.g., a single die cutting operation). In some embodiments, the foldable material may be die cut from a stock material (e.g., a sheet or roll of material). Single integrally formed pieces of material that are cut by a single cutting operation may facilitate efficient and reproducible manufacturing of cable retainers. Moreover, such manufacturing may reduce waste material during manufacturing. Finally, mechanically interlocking portions of the packaging, for example, using a tab and slot, may reduce or completely eliminate adhesives from the cable retainer.

These and other embodiments are discussed below with reference to the figures. However, those skilled in the art will readily appreciate that the detailed description given herein with respect to these figures is for explanatory purposes only and should not be construed as limiting.

In some embodiments, for example as shown in FIG. 1, cable retainer 200 may retain a wound cable 110 in a cavity 120 of product packaging 100. Product packaging 100 may be used to package, for example, a cable alone, or a cable with other components, such as, for example, an electronic device. Product packaging 100 may include one or more additional cavities 120 for holding accessories. In some embodiments, wound cable 110 includes plugs 162. Plugs 162 may be, for example, Universal Serial Bus (USB) plugs (which may also deliver power), a High-Definition Multimedia Interface (HDMI) plug, an Ethernet plug, or a Lightning™ plug, manufactured by Apple Inc. of Cupertino, Calif.

Figure 2:
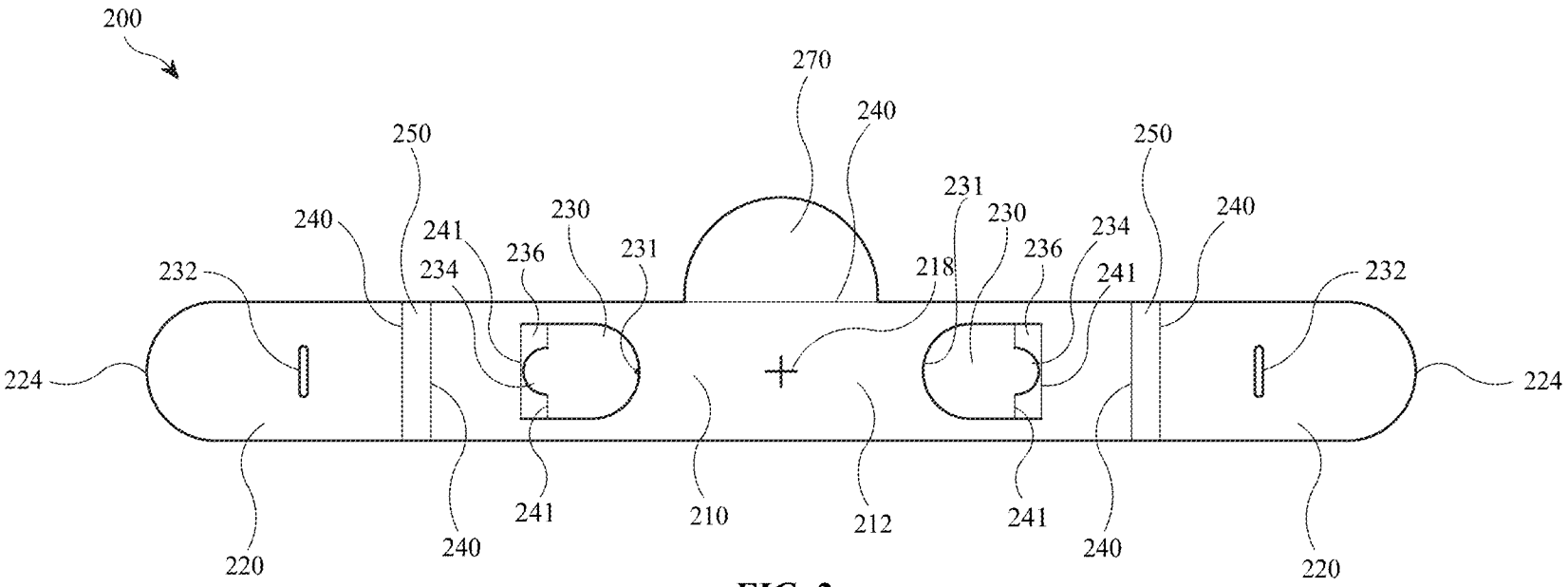
FIG. 2 shows the cable retainer in a flat configuration.
Figure 3:
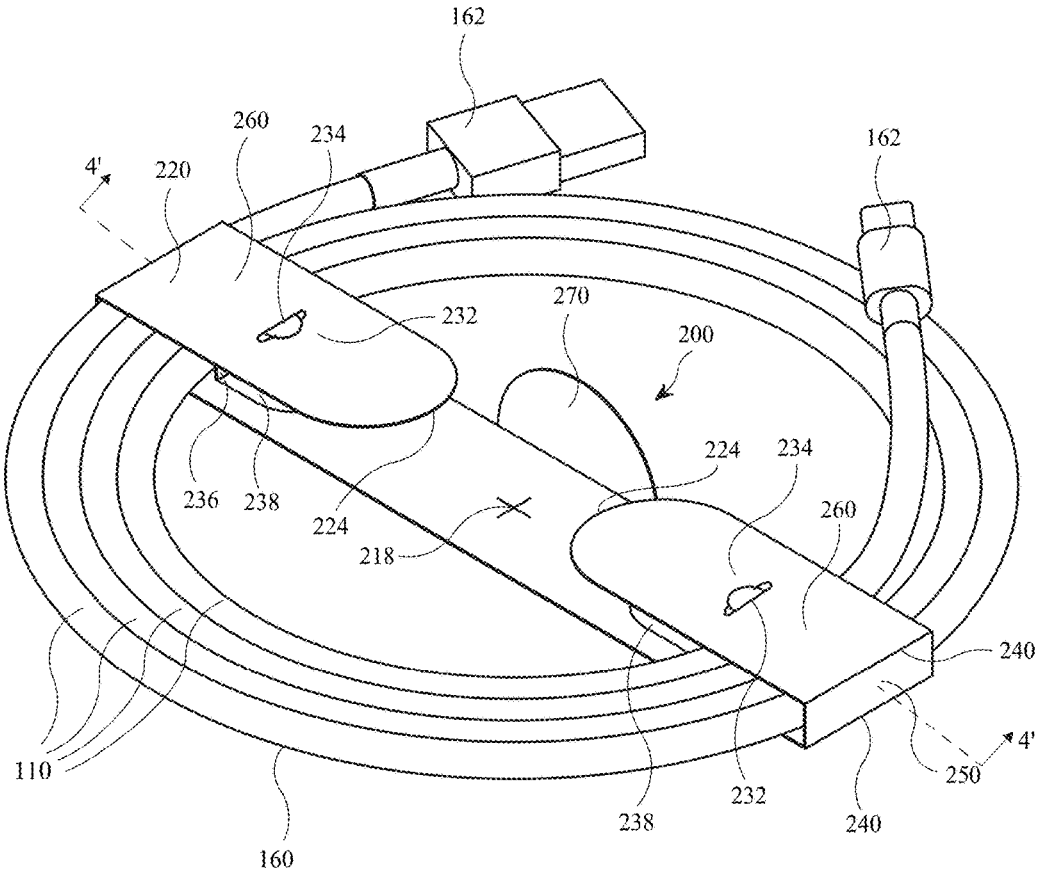
FIG. 3 shows a perspective view of the cable retainer folded about a wound cable.
Figure 4:
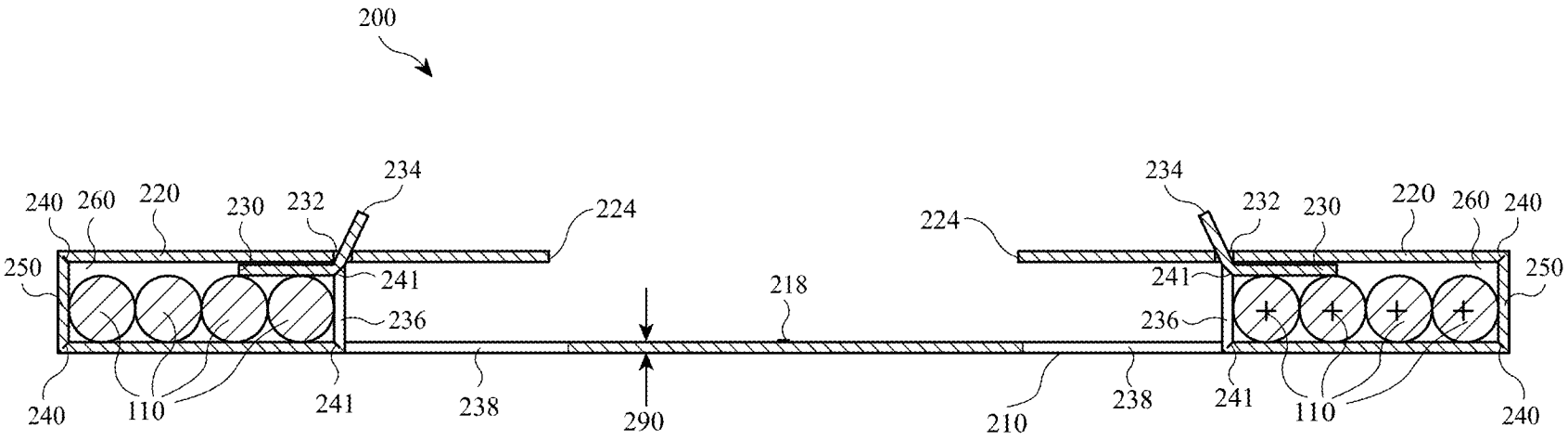
FIG. 4 shows a cross-sectional view along the line 4-4' in FIG. 3.

As shown in FIGS. 2-4, cable retainer 200 may include a panel 210. Panel 210 may have a panel thickness 290 (see FIG. 4) of a sheet of paper or cardstock, for example, 0.1 millimeters to 1 millimeter. Panel 210 may be made entirely from paper. As used herein, paper includes paper-based materials (i.e., cellulose pulp compacted into a flat sheet and dried). Panel 210 may be made entirely from recycled paper. Additionally, the paper forming panel 210 may include a coating on its exterior surface to augment or otherwise change its visual and structural characteristics. For example, the coating may be a laminate applied to a surface of panel 210 to increase its strength or to give it a glossy appearance. A laminate may be applied to select portions of panel 210 or may be applied to the entire surface of panel 210. The coating may be tailored to the specific application of cable retainer 200. In some embodiments, the coating may be formed of a recyclable material. In this way, the coating and cable retainer 200 may be recycled without the need to separate the coating and the cable retainer and may be recycled in a single stream. The cable retainer may be formed of a single integrally formed piece. The cable retainer may also be formed of multiple pieces that mechanically lock or are otherwise coupled to one another. The integrally formed piece may be formed from a blank.

A removal tab 270 may be hingedly coupled to panel 210. Removal tab 270 may be folded up from panel 210 at fold lines 240. Removal tab 270 may aid a customer in removing cable retainer 200 with wound cable 110 from product packaging 100.

Fingers 220 are hingedly coupled to panel 210 at a fold line 240. One or more segments (e.g. a finger segment 250) may connect fingers 220 to panel 210. For example, as shown in FIG. 2, fingers 220 include finger segments 250 disposed between, and hingedly coupling, panel 210 and fingers 220. Fingers 220 include finger tips 224. Fingers 220 are formed symmetrically from panel 210 about center 218 of panel 210. Slots 232 may be cut into fingers 230. Slots 232 may be a single, narrow cut through fingers 220 or slots 232 may have a wider geometry such as an oval cut out (as shown in FIG. 2).

Fold lines 240 may be formed by, for example, structurally weakened regions of cable retainer 200 (e.g., grooves, perforated lines, and depressions formed in cable retainer 200). Grooves may be formed by removing material from the surface of cable retainer 200. For example, grooves may be V-shaped or U-shaped and formed in a surface of cable retainer 200. The fold lines may be preformed into the single integrally formed cable retainer.

Cable retainer 200 may include one or more flaps 230. Flaps 230 may be formed in panel 210 and may be cut from the interior of the panel 210 such that cable retainer 200 may be formed from a single piece of paper. Flaps 230 may be coupled to panel 210 at flap fold lines 241. Flap folding members 236 may be located between, and hingedly coupled to, flaps 230 and panel 210. Flap folding members 236 may have a width approximately the same as finger segments 250. Flaps 230 may have a flap end 231 defining an extreme point of flaps 230.

Flaps 230 may include tabs 234. Tabs 234 may be formed from flaps 230 when flaps 230 are folded at a flap fold line 241. For example, tabs 234 may interrupt fold lines 241 such that fold line 241 does not extend entirely across flap 230. For example, as shown in FIG. 2, flaps 230 have tabs 234 formed opposite of flap ends 231. Tabs 234 may be formed in the same plane, and remain in the same plane, as flaps 230. Tabs 234 may be semi-circular and may face the opposite direction as a semicircular end portion of flaps 230. In some embodiments, tabs 234 may be folded from flaps 230 to lie in a different plane.

In operation, cable retainer 200 may be configured to fold from a flat configuration (see e.g., FIG. 2) to a folded configuration (see e.g., FIG. 3). In the folded configuration, fingers 220 and flaps 230 may be folded about their respective fold lines 240/241 to folded positions.

A method of constructing a cable retainer according to one embodiment will now be described in detail with reference to FIGS. 2-4. Cable retainer 200 of FIG. 2 may be used to form cable retainer 200 as shown in FIGS. 3 and 4.

Folding flaps 230 at flap fold lines 241 extends tabs 234 toward center 218 of panel 210. When flaps 230 and fingers 220 are folded, tabs 234 may pass through slots 232. Once tabs 234 pass through slots 232, fingers 220 and flaps 230 are restrained from folding back towards the flat state. In this way, cable retainer 200 may be made without the use of adhesive, using only the mechanical interlocking of tabs 234 and slots 232. Folding flaps 230 and fingers 220 creates cable passages 260. As shown in FIG. 3, cable passages 260 are rectangular, which can help to securely hold cables by providing applied forces at contact points at tangents along the sides of the cable, as will be explained in more detail below with reference to FIG. 8.

Finger tips 224 may be folded toward center 218 of panel 210. Fingers 220 are folded until parallel to panel 210 and finger segments 250 are perpendicular to panel 210. Fingers 220 and finger segments 250 may be folded at finger fold lines 240. Flaps 230 may be folded at flap fold lines 241. Each fold at flap fold lines 241 of flaps 230 may be a right-angle fold such that flap ends 231 of flaps 230 moves further from center 218 of panel 210. In this way, flaps 230 are parallel to panel 210 and fingers 220 and flap folding members 236 are perpendicular to panel 210. In some embodiments, flaps 230 lie between fingers 220 and panel 210 in the folded configuration.

FIG. 3 shows a perspective view of cable retainer 200 in a folded configuration. Cable retainer 200 has wound cable 110 extending through cable passages 260. Wound cable 110 may be looped through cable passages 260 multiple times (e.g., one or more loops of wound cable 110 may extend though cable passages 260). Each loop of wound cable 110 extending through cable passages 260 is disposed on the same plane. For example, wound cable 110 may be disposed on a plane parallel to panel 210 or parallel to flap folding member 236. As seen in FIG. 3, folding flaps 230 creates voids 238 in panel. Voids 238 may be used to align cable retainer 200 in pocket 120 of product packaging 100.

A customer may remove cable retainer 200 from product packaging 100 by pulling removal tab 270. Cable retainer 200 may be sufficiently stiff such that removal tab 270 remains substantially perpendicular to panel 210 when cable retainer 200 containing wound cable 110 is held by removal tab 270 only. Removal tab 270 may take a variety of shapes, including, for example, semi-circular.

A customer may remove wound cable 110 from cable retainer 200 by pulling finger tips 224 away from center 218 of panel 210. Pulling finger tips 224 will cause tabs 234 to slide though slots 232 thereby releasing fingers 220 and tabs 234 from one another. Once fingers 220 and tabs 234 are released, wound cable 110 may be removed from cable retainer 200.

FIG. 4 shows a cross-sectional view of cable retainer 200 and wound cable 110 taken at line 4-4' of FIG. 3. FIG. 4 shows cable retainer 200 in the folded configuration. Folded fingers 220 and folded flaps 230 form cable passages 260. Wound cable 110 lies in cable passages 260. As discussed above, cable passages 260 are formed by panel 210, intermediate panels 250, fingers 220, flaps 230, and flap folding members 236. Fingers 220 and flaps 230 lie parallel to one another and tabs 234 extend from the rear of flaps 230 toward center of panel 218, passing through slots 232 formed in fingers 220. Finger fold lines 240 and flap fold lines 241 are also shown for reference.

Figure 5:
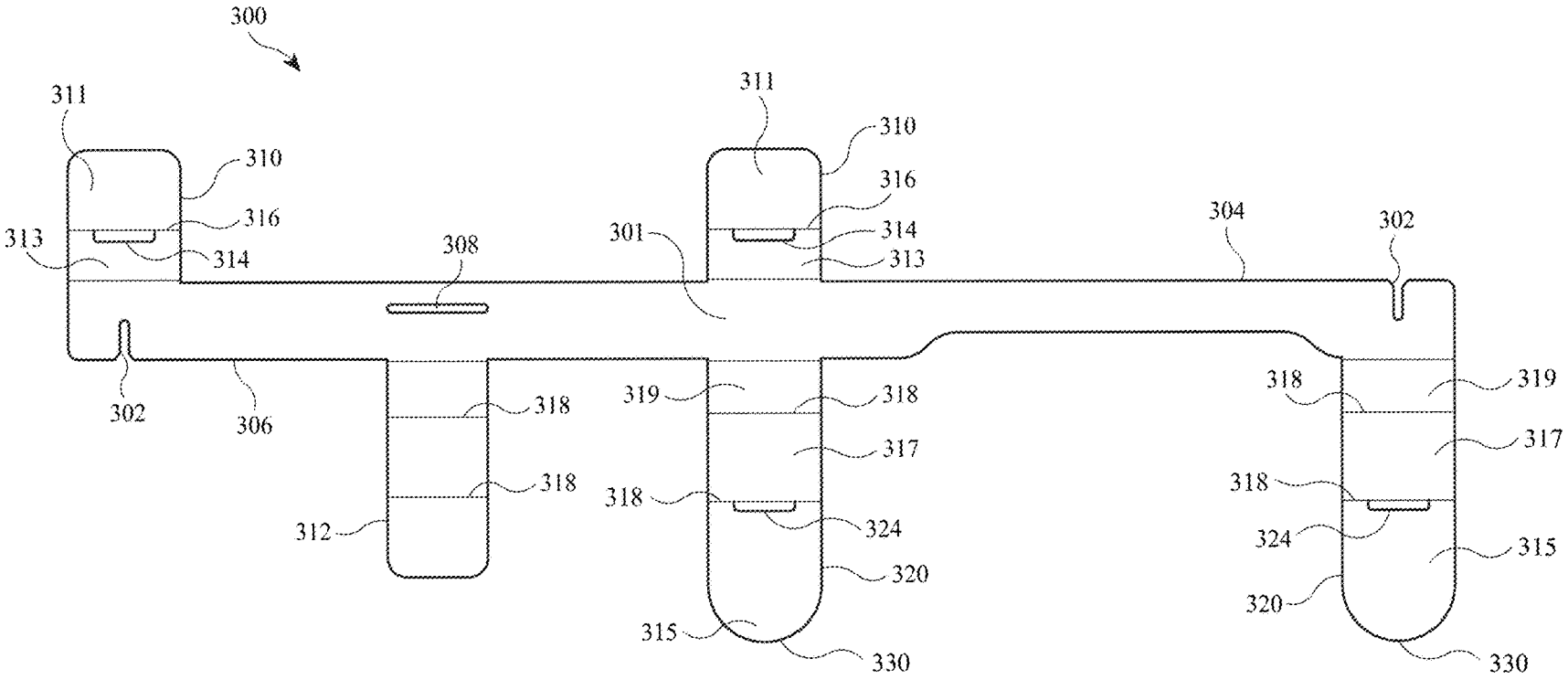
FIG. 5 shows a cable retainer in a flat configuration.

FIG. 5 shows a cable retainer 300 according to some embodiments disclosed herein. Cable retainer 300 includes panel 301. Flaps 310 extend from an upper side 304 of panel 301. In some embodiments, flaps 310 have flap fold lines 316 formed thereon. For example, fingers 320 may extend from a lower side 306 of panel 301. Flaps 310 on upper side 304 and fingers 320 on lower side 306 may be located such that when cable retainer 300 is formed into a loop, each flap 310 is opposite a finger 320. In this way, each finger 320 is paired with one flap 310. Cable retainer 300 may be formed into a loop by connecting loop locks 302.

A port securement member 312 may extend from one of the upper side 304 and lower side 306 of cable retainer 300. Port securement member 312 may have fold lines 318 formed thereon. Port securement member 312 may be folded at fold lines 318 and may be inserted into a plug 162 of a wound cable 110. Port securement member 312's natural spring between the folded portions of port securement member 312 may frictionally hold port securement member 312 inside of plugs 162. A port slit 308 may also be formed into panel 301. In some embodiments, port securement member 312 may pass through port slit 308.

A method of constructing a cable retainer according to one embodiment will now be described in detail with reference to FIGS. 5 and 6. Cable retainer 300 of FIG. 5 may be used to form cable retainer 300 as shown in FIG. 6.

Flaps 310 may be folded at a right angle at each of flap fold lines 316 such that an upper flap segment 311 of flap 310 is parallel to panel 301 and a lower flap segment 313 is perpendicular to panel 301. Once folded, tabs 314 extend in the same plane as upper flap segment 311 beyond lower flap segment 313. Fingers 320 are folded at a right angle at each of fold lines 318. Fingers 320 are composed of three segments. As shown in FIG. 5 for example, each of fingers 320 has a finger first segment 315, a finger second segment 317, and a finger third segment 319.

Figure 6:
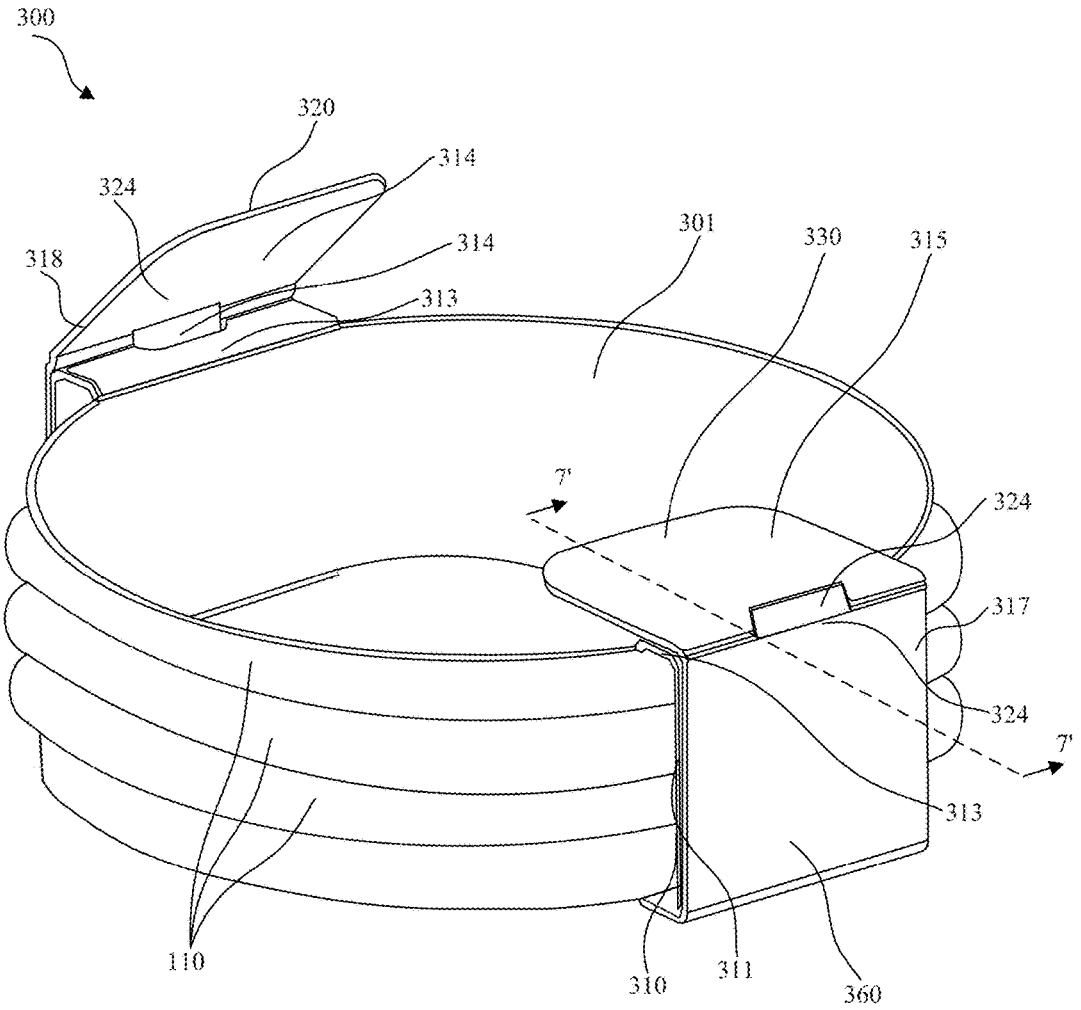
FIG. 6 shows a perspective view of the cable retainer folded about a wound cable.

FIG. 6 shows a perspective view of cable retainer 300 in a folded configuration. Cable retainer 300 has wound cable 110 extending through a cable passage 360. Wound cable 110 may be looped through cable passage 360 multiple times (e.g., one or more loops of wound cable 110 may extend though cable passage 360). Each loop of wound cable 110 that extends through cable passage 360 is disposed on the same plane. For example, wound cable 110 may be disposed on a plane parallel to panel 301 or parallel to flap folding member 326.

According to some embodiments, a customer may remove wound cable 110 from cable retainer 300 by pulling finger tips 330 in the direction of tabs 324. Pulling finger tips 330 will cause tabs 314 to slide though slots 232 thereby releasing fingers 220 and tabs 314 from one another. Once fingers 320 and tabs 314 are released, wound cable 110 may be removed from cable retainer 300.

Figure 7:
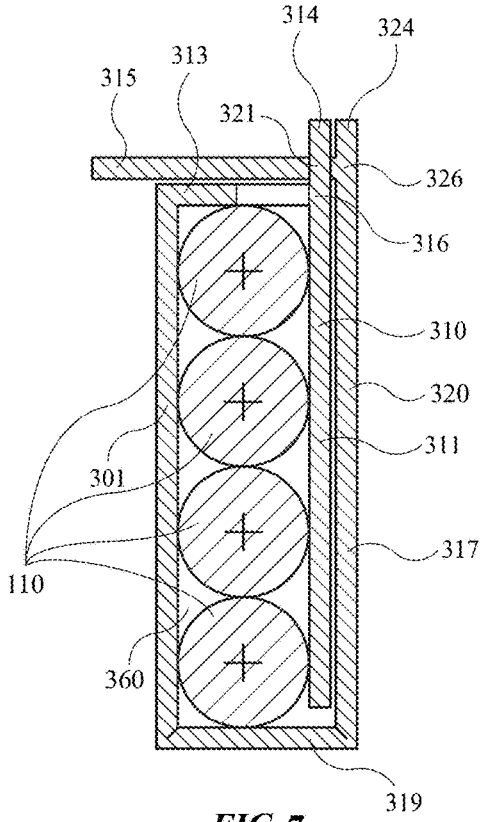
FIG. 7 shows a detail cross-sectional view along the line 7-7' in FIG. 6.

FIG. 7 shows cable passage 360 according to some embodiments. Cable passage 360 is formed of finger first segment 315, flap segments 313, panel 301, and flaps 310. Finger first segment 315 is parallel to upper flap segment 311. Finger second segment 317 is parallel to flap 310's lower flap segment 313 and finger third segment 319 is parallel to lower flap segment 313. Tabs 314 are parallel to finger tabs 324.

As stated above, cable passage 360 is formed from panel 301, fingers 320, and flaps 310. Tabs 314 extend through slot 321 and are parallel with finger tabs 324. Finger tabs 324 are formed when fingers 320 are folded at fold line 326. The portion of finger first segment 315 that was previously adjacent finger tabs 324 becomes slot 321 through which tabs 314 may extend.

Figure 8:
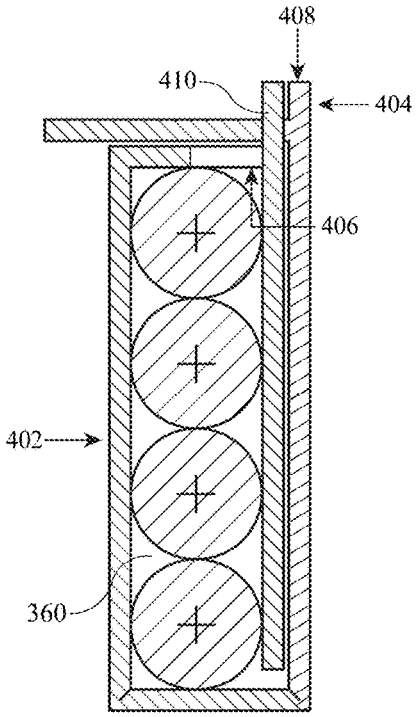
FIG. 8 shows a free body diagram of the detailed cross-sectional view in FIG. 7.

FIG. 8 shows a free body diagram of the cable passage shown in FIG. 7. Wound cable 110 may be compressed by the walls of cable passage 360, and may act as a spring exerting forces on cable passage 360. The forces exerted by wound cable 110 contained in cable passage 360 can be resolved into horizontal force 402 and vertical force 406.

Cable passage 360 resists horizontal force 402 and vertical force 406 with tabs 314, slots 321, and finger tabs 324. With reference to FIGS. 7 and 8, horizontal force 402 is resisted by the interference of tabs 314 with the boundary of slots 321 and finger tabs 324. Vertical force 406 is resisted by the interference of tabs 314 with the boundary of slots 321. In this way, cable passage 360 is able to retain shape without the use of adhesives.

While the retainer is primarily described with reference to retaining and packing cables, it should be appreciated that the retainers described herein and the principles that guide their operation are applicable to a wide variety of product retention and packaging applications. For example, retainers using mechanical interlocks such as those described herein may be used to retain material or products for storage, shipping, packaging, or displaying. For example, a retainer using a mechanical interlock may be used to bundle pencils together. Further, retainers may be used to bundle related consumer products such as, for example, a printer cord and printer ink, into a single integrated packaging unit. The retainer may also retain a cable and a portion of a retained product, such as, for example, headphone cables and headphones.

The foregoing descriptions of the specific embodiments described herein are presented for purposes of illustration and description. These exemplary embodiments are not intended to be exhaustive or to limit the embodiments to the precise forms disclosed. All specific details described are not required in order to practice the described embodiments.

It will be apparent to one of ordinary skill in the art that many modifications and variations are possible in view of the above teachings, and that by applying knowledge within the skill of the art, one may readily modify and/or adapt for various applications such specific embodiments, without undue experimentation, without departing from the general concept of the present invention. Such adaptations and modifications are intended to be within the meaning and range of equivalents of the disclosed embodiments, based on the teaching and guidance presented herein.

The Detailed Description section is intended to be used to interpret the claims. The Summary and Abstract sections may set forth one or more but not all exemplary embodiments of the present invention as contemplated by the inventor(s), and thus, are not intended to limit the present invention and the claims.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The phraseology or terminology used herein is for the purpose of description and not limitation, such that the terminology or phraseology of the present specification is to be interpreted by the skilled artisan.

The breadth and scope of the present invention(s) should not be limited by any of the above-described exemplary embodiments, but should be defined only in accordance with the claims and their equivalents.

What is claimed is:

1. A cable retainer comprising:

a panel comprising a pair of loop locks configured to engage each other to form a loop;

a first retention loop and a second retention loop, each retention loop comprising:

a finger having a slot formed in a fold line of the finger; and a flap having a tab formed in a fold line of the flap;

wherein the finger and the flap of the first retention loop are located directly across the panel from one another, wherein the finger of the second retention loop is located at a first end of the panel, and wherein the flap of the second retention loop is located at a second end of the panel, wherein the tab and slot of each retention loop interlock to form a rectangular cable passage, and wherein the cable retainer is formed entirely of paper, with no adhesive.

2. The cable retainer of claim 1, wherein the cable retainer is a single integrally formed piece.

3. The cable retainer of claim 2, wherein the single integrally formed piece is formed from a flat blank.

4. The cable retainer of claim 2, wherein the cable retainer is coated with a laminate.

5. The cable retainer of claim 2, wherein fold lines are preformed in the single integrally formed piece.

6. The cable retainer of claim 1, further comprising:

a foldable port securement member extending from the panel;

wherein the port securement member is configured to mate with a port of a retained cable.

7. The cable retainer of claim 6, wherein the port securement member is configured to fold into the port of the retained cable.

8. The cable retainer of claim 1, wherein each tab may be removed from and reinserted into the slot.

9. A packaged cable comprising:

the cable retainer of claim 1; and a wound cable extending through the retention loops of the cable retainer.

10. The packaged cable of claim 9, wherein the cable is wound such that each loop of the cable is in contact with an immediately adjacent loop along a majority of each loop's length.

11. A cable retainer comprising:

a finger having finger segments;

a flap having flap segments;

wherein a tab is formed in a fold line between the flap segments, and wherein the tab engages a slot formed in a fold line between the finger segments to form a retention loop from the finger and the flap.

12. The cable retainer of claim 11, wherein each finger segment is folded at a right angle relative to an adjacent finger segment.

13. The cable retainer of claim 11, further comprising:

a second finger and a second flap forming a second retention loop; and a panel extending between the first retention loop and the second retention loop.

14. A packaged cable comprising:

the cable retainer of claim 13; and a wound cable extending through the retention loops of the cable retainer, wherein each loop of the wound cable is disposed on the same plane.

15. The cable retainer of claim 13, further comprising a semi-circular removal tab extending from the panel.

16. A cable retainer comprising:

a panel having at least three folds; and a tab formed in a fold line of the panel, the tab extending through a slit formed in the panel to form a passage for retaining a wound cable, wherein the cable retainer is formed entirely of paper, with no adhesive.

17. The cable retainer of claim 16, wherein a first one of the folds does not extend entirely across the panel, and connects to a cut-out from the panel.

18. The cable retainer of claim 17, wherein a second one of the folds is formed in the cut-out, and is interrupted by the tab such that the second fold does not extend entirely across the cut-out.

19. The cable retainer of claim 17, wherein the cut-out has a semi-circular end, wherein the tab has a semi-circular end, and wherein the semi-circular ends of the cut-out and the tab point in opposite directions.

20. The cable retainer of claim 16, further comprising a second tab extending from the panel at a second fold line of the panel, the second tab extending through a second slit formed in the panel to form a second passage for retaining the wound cable.

* * * * *